US011521503B2

(12) United States Patent
Bush

(10) Patent No.: US 11,521,503 B2
(45) Date of Patent: Dec. 6, 2022

(54) METHODS AND SYSTEMS FOR AUTHENTICATING AN AUTOMATIC DEPENDENT SURVEILLANCE-BROADCAST (ADS-B) SIGNAL

(71) Applicant: The Boeing Company, Chicago, IL (US)

(72) Inventor: John E. Bush, Everett, WA (US)

(73) Assignee: The Boeing Company, Chicago, IL (US)

( * ) Notice: Subject to any disclaimer, the term of this patent is extended or adjusted under 35 U.S.C. 154(b) by 662 days.

(21) Appl. No.: 16/457,319

(22) Filed: Jun. 28, 2019

(65) Prior Publication Data

US 2022/0351632 A1 Nov. 3, 2022

(51) Int. Cl.
*G08G 5/00* (2006.01)

(52) U.S. Cl.
CPC ..... *G08G 5/0078* (2013.01); *G08G 5/0008* (2013.01); *G08G 5/0052* (2013.01)

(58) Field of Classification Search
CPC ..... G08G 5/0078
See application file for complete search history.

(56) References Cited

U.S. PATENT DOCUMENTS 9,432,611 B1 * 8/2016 Nelson ..... H03J 9/00
9,476,962 B2 10/2016 Murphy et al.
9,910,160 B2 3/2018 Geren et al.
10,134,294 B2 11/2018 Feng et al.
2003/0060941 A1 * 3/2003 Griffith ..... G01S 5/0027 701/3
2006/0119515 A1 * 6/2006 E. Smith ..... G08G 5/0082 342/450
2012/0041620 A1 * 2/2012 Stayton ..... G08G 5/0013 701/3
2018/0172797 A1 6/2018 Hauswald et al.
2019/0333397 A1 * 10/2019 Schupp ..... B64D 45/00

FOREIGN PATENT DOCUMENTS

EP 3 483 860 A1 5/2019

OTHER PUBLICATIONS

Extended European Search Report prepared by the European Patent Office in application No. EP 20 17 2645.2 dated Oct. 9, 2020.

* cited by examiner

*Primary Examiner* — Jeff A Burke
*Assistant Examiner* — Christopher A Buksa
(74) *Attorney, Agent, or Firm* — McDonnell Boehnen Hulbert & Berghoff LLP

(57) ABSTRACT

A method includes receiving, by a computing system, a first authenticated signal that (i) identifies a first position of a first aircraft relative to a host aircraft on which the computing system is located and (ii) includes a first identifier of the first aircraft, receiving, at a subsequent time, a second signal that is an ADS-B signal that identifies a second position, a velocity, and an aircraft type, where the second signal includes a second identifier, based on matching the first identifier and the second identifier such that the second signal corresponds to the first aircraft, using the first position and the aircraft type to confirm that it is possible that the first aircraft is located at the second position moving at the velocity at the subsequent time, and based on a confirmation that it is possible, providing an indication that the second signal is authentic.

20 Claims, 7 Drawing Sheets

METHODS AND SYSTEMS FOR AUTHENTICATING AN AUTOMATIC DEPENDENT SURVEILLANCE-BROADCAST (ADS-B) SIGNAL

FIELD

The present disclosure generally relates to systems and methods for signal authentication, and more specifically to systems and methods for authenticating an Automatic Dependent Surveillance-Broadcast (ADS-B) Signal.

BACKGROUND

ADS-B is an aircraft tracking technology in which an aircraft periodically broadcasts its identification, altitude, velocity, and position determined via the Global Positioning System (GPS) protocol. Air traffic control stations on the ground and other aircraft can receive and use the broadcasted information to coordinate the flight of many aircraft and help prevent mid-air collisions.

One disadvantage of the ADS-B system is that it does not include a protocol for authenticating received signals. That is, a premise of the system is that the aircraft identification and the corresponding altitude, position, and velocity conveyed by a received signal are accurate. Thus, there is a degree of uncertainty regarding the content of ADS-B messages. This issue particularly applies to unmanned aerial vehicles (UAVs) equipped with an ADS-B system because UAVs do not have a pilot onboard that could use his or her own vision or hearing to verify the information included in a received ADS-B signal. Thus, a need exists for systems and methods that can authenticate ADS-B signals.

SUMMARY

One aspect of the disclosure is a computing system for evaluating an Automatic Dependent Surveillance-Broadcast (ADS-B) signal for authenticity, the computing system comprising: one or more processors; and a computer readable medium storing instructions that, when executed by the one or more processors, cause the computing system to perform functions comprising: receiving a first authenticated signal that (i) identifies a first position of a first aircraft relative to a host aircraft on which the computing system is located and (ii) includes a first identifier of the first aircraft; receiving, at a subsequent time, a second signal that is an ADS-B signal that identifies a second position, a velocity, and an aircraft type, wherein the second signal includes a second identifier; based on matching the first identifier and the second identifier such that the second signal corresponds to the first aircraft, using the first position and the aircraft type to confirm that it is possible that the first aircraft is located at the second position moving at the velocity at the subsequent time; and based on a confirmation that it is possible that the first aircraft is located at the second position moving at the velocity at the subsequent time, providing an indication that the second signal is authentic.

Another aspect of the disclosure is a non-transitory computer readable medium storing instructions that, when executed by a computing system, cause the computing system to perform functions for evaluating an Automatic Dependent Surveillance-Broadcast (ADS-B) signal for authenticity, the functions comprising: receiving a first authenticated signal that (i) identifies a first position of a first aircraft relative to a host aircraft on which the computing system is located and (ii) includes a first identifier of the first aircraft; receiving, at a subsequent time, a second signal that is an ADS-B signal that identifies a second position, a velocity, and an aircraft type, wherein the second signal includes a second identifier; based on matching the first identifier and the second identifier such that the second signal corresponds to the first aircraft, using the first position and the aircraft type to confirm that it is possible that the first aircraft is located at the second position moving at the velocity at the subsequent time; and based on a confirmation that it is possible that the first aircraft is located at the second position moving at the velocity at the subsequent time, providing an indication that the second signal is authentic.

A further aspect of the disclosure is a method for evaluating an Automatic Dependent Surveillance-Broadcast (ADS-B) signal for authenticity, the method comprising: receiving, by a computing system, a first authenticated signal that (i) identifies a first position of a first aircraft relative to a host aircraft on which the computing system is located and (ii) includes a first identifier of the first aircraft; receiving, at a subsequent time, a second signal that is an ADS-B signal that identifies a second position, a velocity, and an aircraft type, wherein the second signal includes a second identifier; based on matching the first identifier and the second identifier such that the second signal corresponds to the first aircraft, using the first position and the aircraft type to confirm that it is possible that the first aircraft is located at the second position moving at the velocity at the subsequent time; and based on a confirmation that it is possible that the first aircraft is located at the second position moving at the velocity at the subsequent time, providing an indication that the second signal is authentic.

By the term "about" or "substantially" with reference to amounts or measurement values described herein, it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

The features, functions, and advantages that have been discussed can be achieved independently in various examples or may be combined in yet other examples further details of which can be seen with reference to the following description and drawings.

BRIEF DESCRIPTION OF THE DRAWINGS

The novel features believed characteristic of the illustrative examples are set forth in the appended claims. The illustrative examples, however, as well as a preferred mode of use, further objectives and descriptions thereof, will best be understood by reference to the following detailed description of an illustrative example of the present disclosure when read in conjunction with the accompanying Figures.

DETAILED DESCRIPTION

Figure 1:
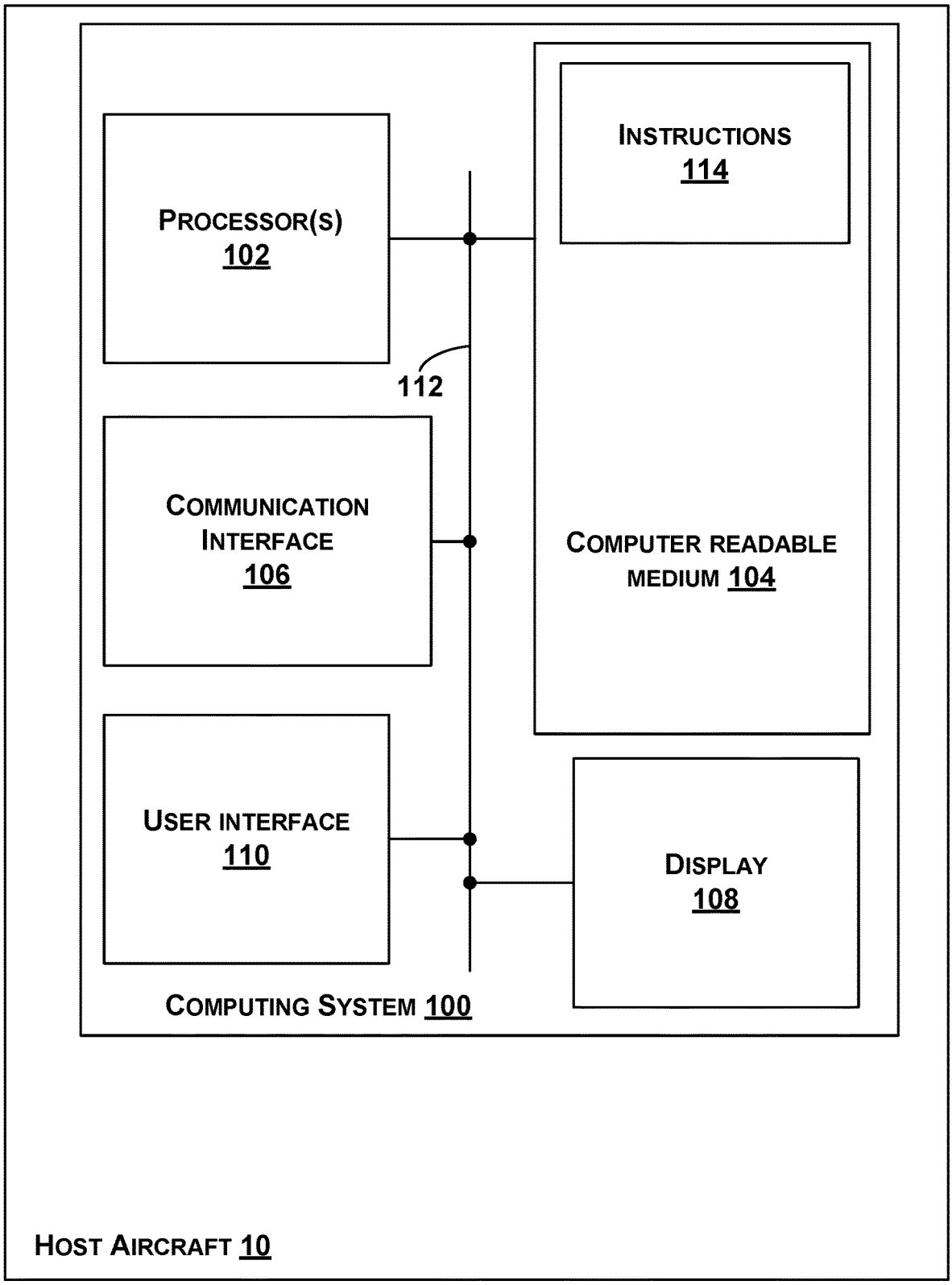
FIG. 1 is a schematic diagram of a host aircraft and a computing system, according to an example.

As discussed above, there exists a need for systems and methods that can authenticate ADS-B signals. Accordingly, this disclosure includes such systems and methods.

Within examples, a computing system aboard a host aircraft can receive, at a first time, a first authenticated signal that (i) identifies a first position of a first aircraft relative to the host aircraft and (ii) includes a first identifier of the first aircraft. For example, the first authenticated signal could be received via an encrypted communication channel (e.g., other than ADS-B) or could be authenticated by comparing the information conveyed by the first authenticated signal to air traffic control information or other verified information. The first authenticated signal can include a call sign of the first aircraft (e.g., any alphanumeric identifier), an altitude of the first aircraft, a bearing of the first aircraft relative to the host aircraft, and a distance between the first aircraft and the host aircraft. Any information conveyed by the first authenticated signal can be explicit or implicit.

The computing system can also receive, at a subsequent time, a second signal that is an ADS-B signal that identifies a second position, a velocity, and an aircraft type. The second signal also includes a second identifier (e.g., any alphanumeric identifier). Any information conveyed by the second signal can be explicit or implicit. Next, the computing system can match the first identifier and the second identifier such that the second signal corresponds to the first aircraft.

The computing system can then use the first position indicated by the first authenticated signal and the aircraft type indicated by the second signal to confirm that it is possible that the first aircraft is located at the second position indicated by the second signal moving at the velocity indicated by the second signal at the subsequent time. For example, the computing system can determine, based on known performance specifications of the aircraft type (e.g., a particular make and model of an aircraft), whether it is possible that the first aircraft was at the first position at the first time when the first authenticated signal was received and also traveling at the second position at the velocity indicated by the second signal at the subsequent time. In some examples, the computing system can infer the aircraft type of the first aircraft from the first identifier or the second identifier. Such performance specifications can include a maximum velocity, a minimum velocity, or a maximum altitude. The computing system can also determine whether the aforementioned position and velocity information is consistent with a known flight plan of the first aircraft. Based on a confirmation that it is possible that the first aircraft is located at the second position moving at the velocity at the subsequent time, the computing system can provide (e.g., via a user interface) an indication that the second signal is authentic.

In some examples, the computing system can additionally receive a third signal that is an ADS-B signal explicitly or implicitly identifying a third position, a second velocity, a second aircraft type, and a third identifier. The computing system can identify a mismatch between the first identifier and the third identifier such that the third signal corresponds to a second aircraft (e.g., a new contact). Using the third position, the second velocity, and/or the second aircraft type, the computing system can confirm that it is possible that the second aircraft is located at the third position moving at the second velocity at the second time and provide an indication to that effect (e.g., via the user interface). For example, the computing system can determine that a distance between the host aircraft and the third position is greater than a standard initial contact distance of ADS-B signals (e.g., a distance at which a new contact would be expected to "appear" via ADS-B tracking).

The systems and methods disclosed herein can be advantageous because, when compared to conventional systems and methods, the systems and methods disclosed herein can help to authenticate ADS-B signals and identify fraudulent ADS-B signals.

Implementations of this disclosure provide technological improvements that are particular to computer networks and computing systems, for example, computing systems used to authenticate radio transmissions and/or identify fraudulent radio transmissions.

Computing system-specific technological problems, such as the management and use of large quantities of complex data stemming from multiple sources such as aircraft and air traffic control stations, as well as inefficiency associated therewith, can be wholly or partially solved by the implementations of this disclosure. For example, implementation of this disclosure can reduce time spent analyzing data to identify authentic signals and fraudulent signals. Thus, implementation of this disclosure can reduce the cost and complexity of implementing less efficient methods and systems for diagnosing and resolving such problems. As another example, implementation of this disclosure increases accuracy and reliability of diagnostic information.

Implementations of this disclosure can thus introduce new and efficient improvements in the ways in which a computing system authenticates radio transmissions, and in turn facilitate new and efficient improvements in the ways in which the associated data is used to diagnose and resolve problems. Implementations of this disclosure can condense and perform calculations with large amounts of information that might not otherwise be easily usable to authenticate radio transmissions.

Disclosed examples will now be described more fully hereinafter with reference to the accompanying Drawings, in which some, but not all of the disclosed examples are shown. Indeed, several different examples may be described and should not be construed as limited to the examples set forth herein. Rather, these examples are described so that this disclosure will be thorough and complete and will fully convey the scope of the disclosure to those skilled in the art.

FIG. 1 is a block diagram of a host aircraft 10, which includes a computing system 100. In some examples, components of the computing system 100 are distributed across multiple computing systems. However, for the sake of example, the components are shown and described as part of the computing system 100. The computing system 100 can be or include a mobile device (such as a mobile phone), a desktop computer, a laptop computer, a tablet computer, a server, a network of multiple servers, or one or more similar devices that can be configured to perform the functions described herein.

As shown in FIG. 1, the computing system 100 includes one or more processors 102, a non-transitory computer readable medium 104, a communication interface 106, a display 108, and a user interface 110. Components of the computing system 100 illustrated in FIG. 1 are linked together by a system bus, network, or other connection mechanism 112.

The one or more processors 102 can be any type of processor(s), such as a microprocessor, a digital signal processor, a multicore processor, etc., coupled to the non-transitory computer readable medium 104.

The non-transitory computer readable medium 104 can be any type of memory, such as volatile memory like random access memory (RAM), dynamic random access memory (DRAM), static random access memory (SRAM), or non-volatile memory like read-only memory (ROM), flash memory, magnetic or optical disks, or compact-disc read-only memory (CD-ROM), among other devices used to store data or programs on a temporary or permanent basis.

Additionally, the non-transitory computer readable medium 104 can be configured to store instructions 114. The instructions 114 are executable by the one or more processors 102 to cause the computing system 100 to perform any of the functions of the computing system 100 described herein.

The communication interface 106 can include hardware to enable communication within the computing system 100 and/or between the computing system 100 and one or more other devices. The hardware can include transmitters, receivers, and antennas, for example. The communication interface 106 can be configured to facilitate communication with one or more other devices, in accordance with one or more wired or wireless communication protocols. For example, the communication interface 106 can be configured to facilitate wireless data communication for the computing system 100 according to one or more wireless communication standards, such as one or more Institute of Electrical and Electronics Engineers (IEEE) 801.11 standards, ZigBee standards, Bluetooth standards, etc. As another example, the communication interface 106 can be configured to facilitate wired data communication with one or more other devices.

The display 108 can be any type of display component configured to display data. As one example, the display 108 can include a touchscreen display. As another example, the display 108 can include a flat-panel display, such as a liquid-crystal display (LCD) or a light-emitting diode (LED) display.

The user interface 110 can include one or more pieces of hardware used to provide data and control signals to the computing system 100. For instance, the user interface 110 can include a mouse or a pointing device, a keyboard or a keypad, a microphone, a touchpad, or a touchscreen, among other possible types of user input devices. Generally, the user interface 110 can enable an operator to interact with a graphical user interface (GUI) provided by the computing system 100 (e.g., displayed by the display 108).

Figure 2:
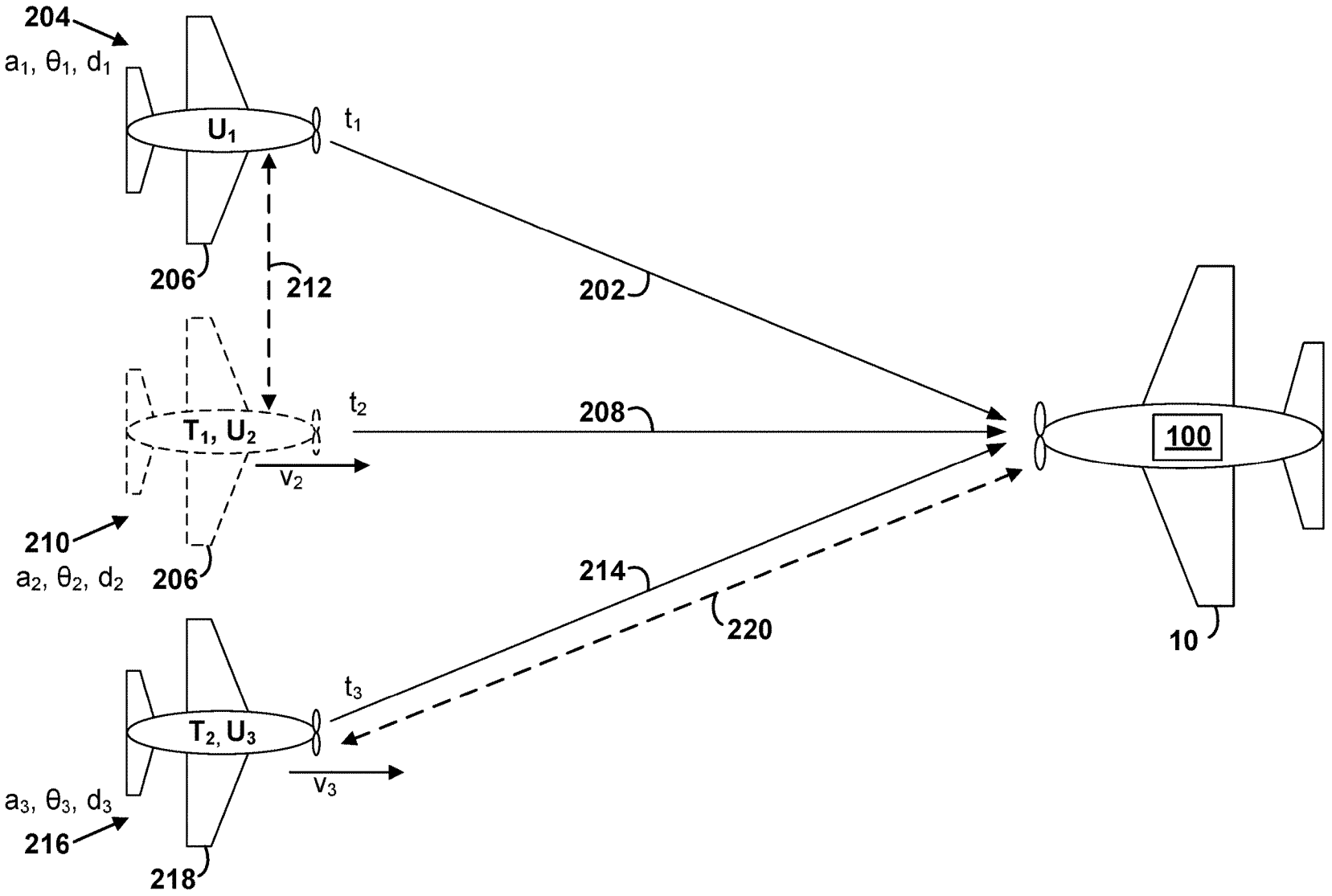
FIG. 2 is a schematic diagram of aircraft and functionality performed by a computing system, according to an example.
Figure 3:
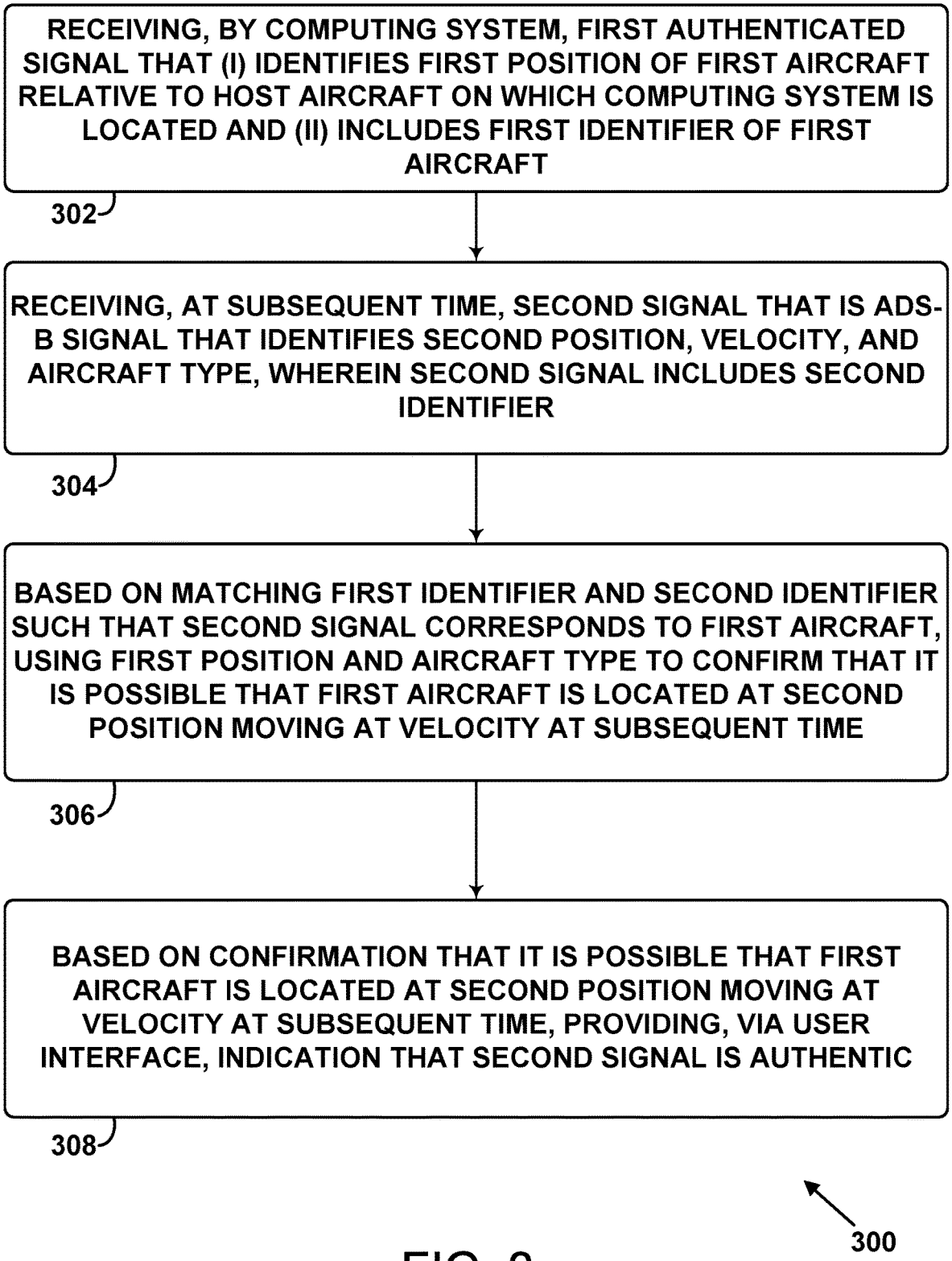
FIG. 3 is a block diagram of a method, according to an example.
Figure 4:
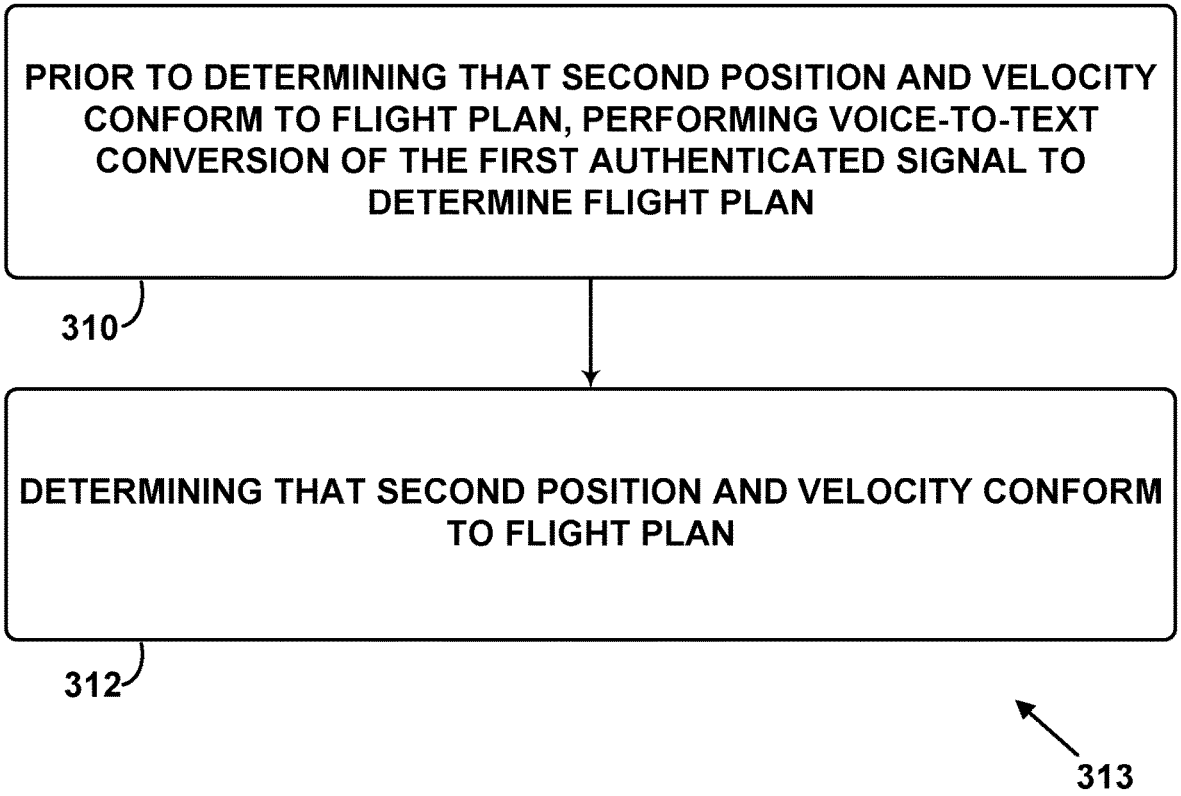
FIG. 4 is a block diagram of a method, according to an example.
Figure 5:
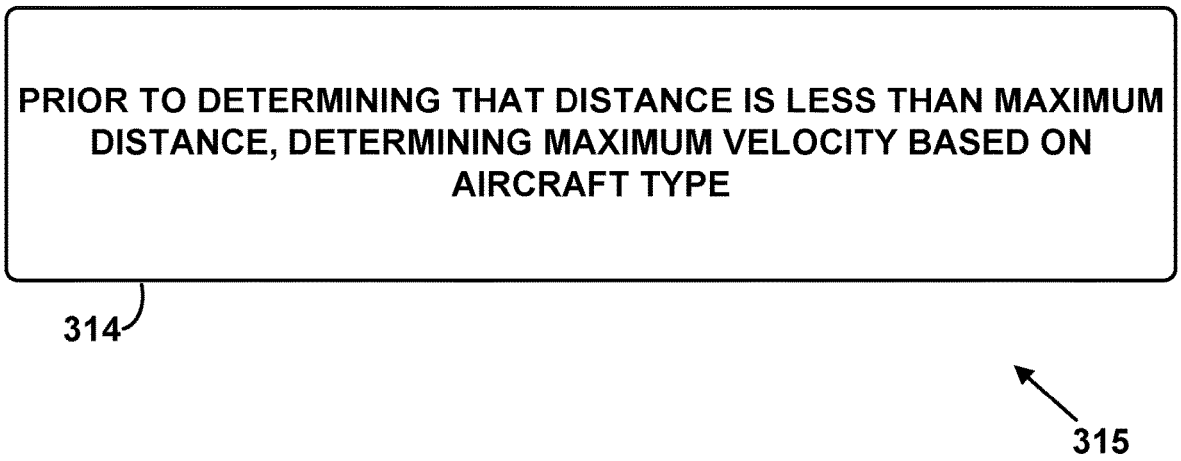
FIG. 5 is a block diagram of a method, according to an example.
Figure 6:
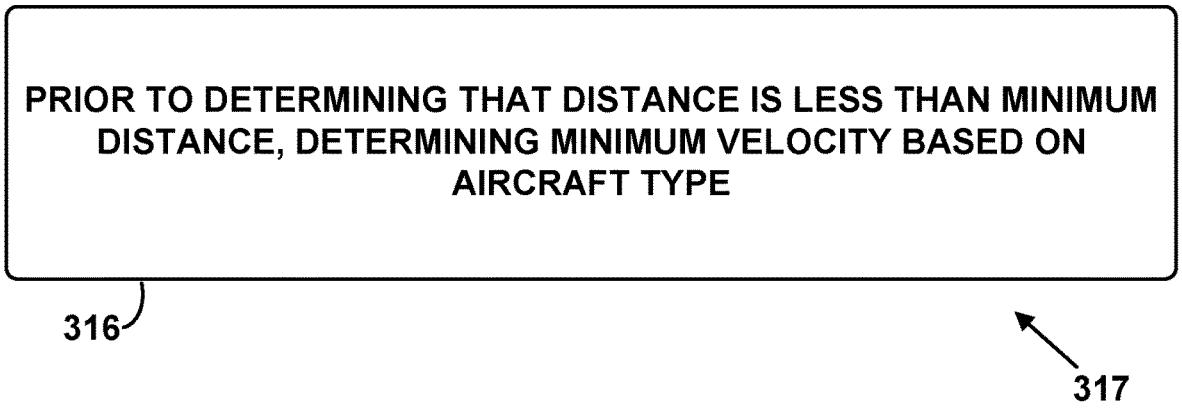
FIG. 6 is a block diagram of a method, according to an example.
Figure 7:
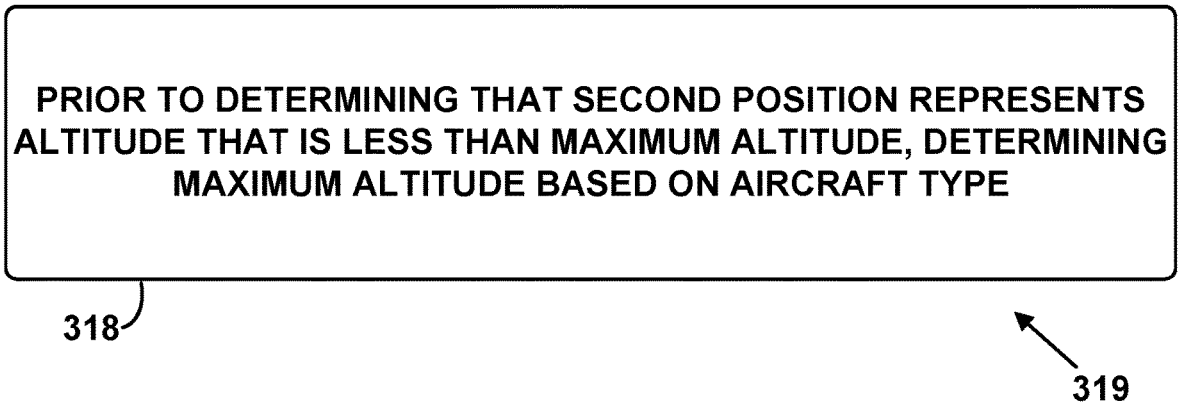
FIG. 7 is a block diagram of a method, according to an example.
Figure 8:
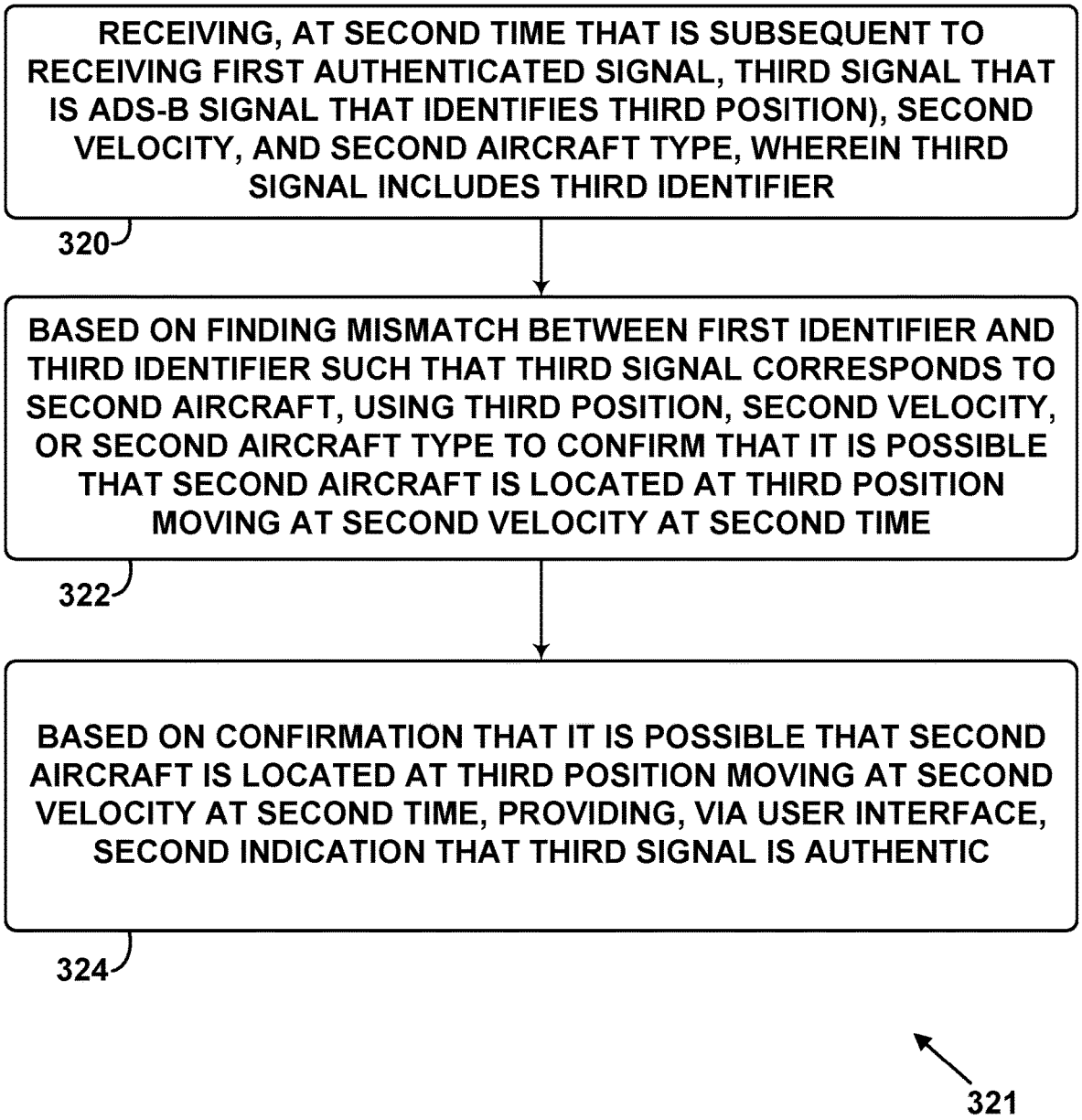
FIG. 8 is a block diagram of a method, according to an example.
Figure 9:
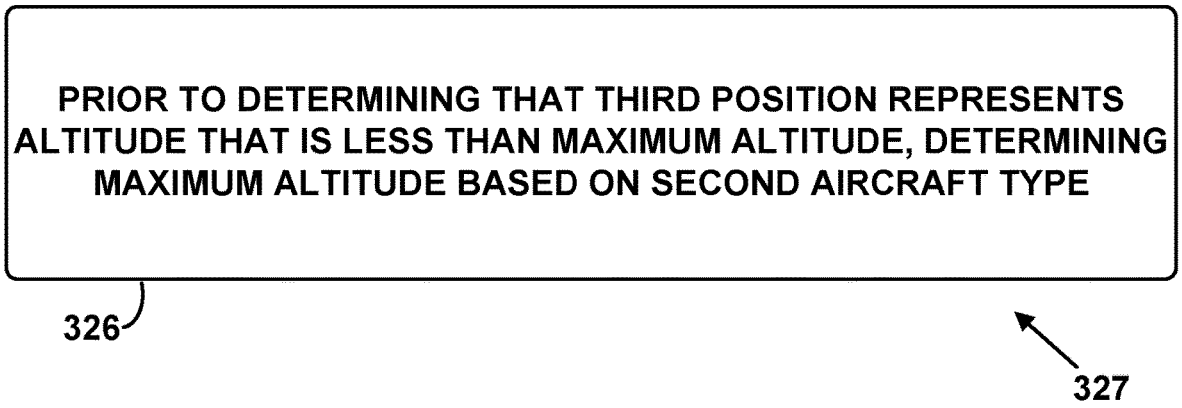
FIG. 9 is a block diagram of a method, according to an example.
Figure 10:
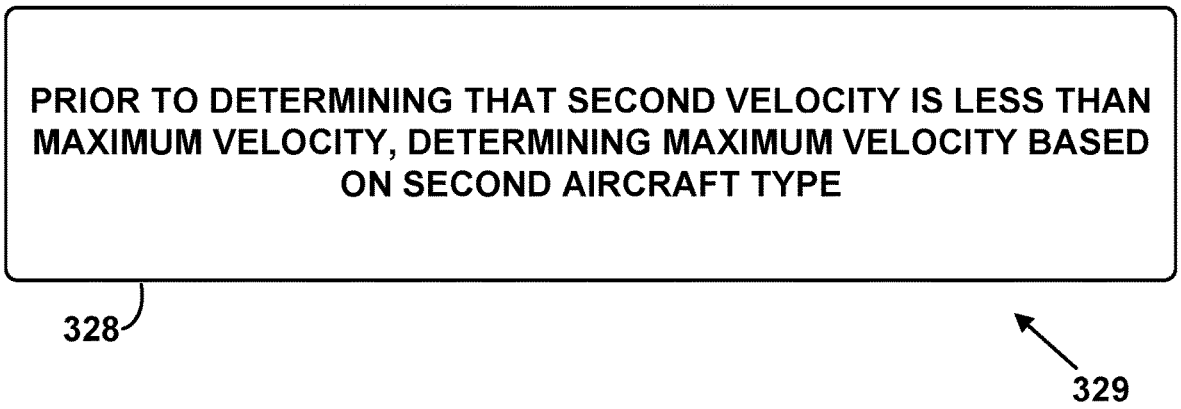
FIG. 10 is a block diagram of a method, according to an example.
Figure 11:
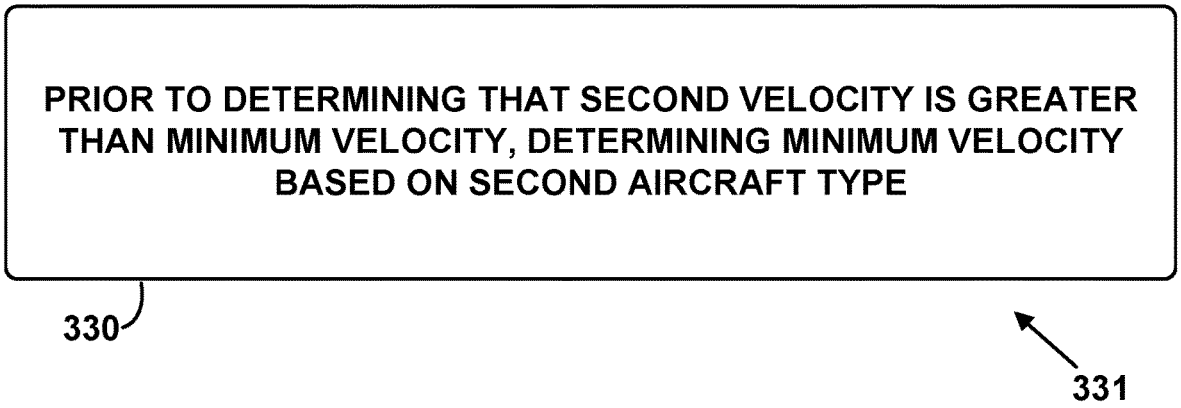
FIG. 11 is a block diagram of a method, according to an example.

FIG. 2 further depicts the host aircraft 10, the computing system 100, and functionality related to the method 300 shown in FIG. 3, the method 313 shown in FIG. 4, the method 315 shown in FIG. 5, the method 317 shown in FIG. 6, the method 319 shown in FIG. 7, the method 321 shown in FIG. 8, the method 327 shown in FIG. 9, the method 329 shown in FIG. 10, and the method 331 shown in FIG. 11.

As shown in FIG. 2, the computing system 100 receives (e.g., wirelessly from a first aircraft 206 at a first time $t_1$) a first authenticated signal 202 that (i) identifies a first position 204 of the first aircraft 206 relative to the host aircraft 10 on which the computing system 100 is located and (ii) includes a first identifier $U_1$ of the first aircraft 206. In other examples, the computing system can receive the first authenticated signal from an air traffic control station. The first position 204 is characterized by an altitude $a_1$, a bearing $\theta_1$ expressed from a perspective of the host aircraft 10, and a distance $d_1$ from the host aircraft 10, but other examples of quantifying the first position are possible.

The first authenticated signal 202 could be received via an encrypted communication channel (e.g., other than ADS-B) or could be authenticated by comparing the information conveyed by the first authenticated signal 202 to air traffic control information or other verified information. The first identifier $U_1$ could include a call sign of the first aircraft 206 (e.g., any alphanumeric identifier). Any information conveyed by the first authenticated signal 202 can be explicit or implicit. In some examples, the first authenticated signal 202 is a Traffic Collision Avoidance System (TCAS) signal received from the first aircraft 206. In other examples, the first authenticated signal is an air traffic control voice (ATCV) signal that encodes air traffic control audio, or a Controller Pilot Data Link (CPDL) signal. ATCV signals and CPDL signals are generally received from an air traffic control station.

The computing system 100 also receives (e.g., wirelessly), at a subsequent time $t_2$, a second signal 208 that is an ADS-B signal that identifies a second position 210, a velocity $v_2$, and an aircraft type $T_1$. The second signal 208 includes a second identifier $U_2$ (e.g., any alphanumeric identifier). Any information conveyed by the second signal 208 can be explicit or implicit. The second position 210 is characterized by an altitude $a_2$, a bearing $\theta_2$ from the perspective of the host aircraft 10, and a distance $d_2$ from the host aircraft 10, but other examples of quantifying the second position are possible. Next, the computing system 100 can match the first identifier $U_1$ and the second identifier $U_2$ such that the second signal 208 corresponds to the first aircraft 206. That is, the computing system 100 determines that the subsequently received second signal 208 corresponds to the same aircraft as the first authenticated signal 202, namely the first aircraft 206.

Based on matching the first identifier $U_1$ and the second identifier $U_2$ such that the second signal 208 corresponds to the first aircraft 206, the computing system 100 uses the first position 204 and the aircraft type $T_1$ (e.g., a particular make and model of an aircraft) to confirm that it is possible that the first aircraft 206 is located at the second position 210 moving at the velocity $v_2$ at the subsequent time $t_2$.

For example, the computing system 100 can determine, based on known performance specifications of the aircraft type $T_1$, whether it is possible that the first aircraft 206 was at the first position 204 at the first time $t_1$ when the first authenticated signal 202 was received and also traveling at the second position 210 at the velocity $v_2$ indicated by the second signal 208 at the subsequent time $t_2$. In some examples, the computing system 100 can infer the aircraft type $T_1$ of the first aircraft 206 from the first identifier $U_1$ or the second identifier $U_2$ (e.g., via a lookup table). Such performance specifications can include a maximum velocity, a minimum velocity, or a maximum altitude. The computing system 100 can also determine whether the aforementioned position and velocity information is consistent with a known flight plan of the first aircraft 206.

Thus, in some examples, the first authenticated signal is an air traffic control voice (ATCV) signal or a Controller Pilot Data Link (CPDL) signal (e.g., received from an air traffic control station) that indicates a flight plan of the first aircraft 206. In this context, the computing system 100 can determine that the second position 210 and the velocity $v_2$ conform to the flight plan (e.g., that the second position 210 and the velocity $v_2$ are within position and velocity limits defined by the flight plan.)

In some examples, the first authenticated signal is an ATCV signal. In this context, the computing system 100 can, prior to determining that the second position 210 and the velocity $v_2$ conform to the flight plan, perform voice-to-text conversion of the first authenticated signal to determine the flight plan of the first aircraft 206.

In some examples, the computing system 100 using the first position 204 and the aircraft type $T_1$ to confirm that it is possible that the first aircraft 206 is located at the second position 210 moving at the velocity $v_2$ at the subsequent time $t_2$ includes determining that a distance 212 between the first position 204 and the second position 210 is less than a maximum distance that the first aircraft 206 could have travelled at a maximum velocity of the aircraft type $T_1$ between the first time $t_1$ and the subsequent time $t_2$. Prior to determining that the distance 212 is less than the maximum distance, the computing system 100 can determine the maximum velocity based on the aircraft type $T_1$ (e.g., via a lookup table).

In some examples, the computing system 100 using the first position 204 and the aircraft type $T_1$ to confirm that it is possible that the first aircraft 206 is located at the second position 210 moving at the velocity $v_2$ at the subsequent time $t_2$ includes determining that the distance 212 is more than a minimum distance that the first aircraft 206 could have travelled at a minimum velocity of the aircraft type $T_1$ between the first time $t_1$ and the subsequent time $t_2$. Prior to determining that the distance 212 is more than the minimum distance, the computing system 100 can determine the minimum velocity based on the aircraft type $T_1$ (e.g., via a lookup table).

In some examples, the computing system 100 using the first position 204 and the aircraft type $T_1$ to confirm that it is possible that the first aircraft 206 is located at the second position 210 moving at the velocity $v_2$ at the subsequent time $t_2$ incudes determining that the second position 210 represents the altitude $a_2$ that is less than a maximum altitude of the aircraft type $T_1$. Prior to determining that the second position 210 represents the altitude $a_2$ that is less than the maximum altitude, the computing system 100 can determine the maximum altitude based on the aircraft type $T_1$ (e.g., via a lookup table).

The computing system 100 can also, based on a confirmation that it is possible that the first aircraft 206 is located at the second position 210 moving at the velocity $v_2$ at the subsequent time $t_2$, provide (e.g., via the user interface 110) an indication (e.g., displayed text, an audio alert, etc.) that the second signal 208 is authentic.

In some examples, the indication provided by the computing system 100 can be less explicit in form, such as the computing system 100 controlling or maneuvering the host aircraft 10 based on the information included in the second signal 208 (e.g., based on an assumption that the first aircraft 206 is located at the second position 210 moving at the velocity $v_2$ at the subsequent time $t_2$). Additionally or alternatively, the indication provided by the computing system 100 can include the computing system 100 transmitting a signal (e.g., to a control station on the ground) indicating that the second signal 208 is authentic. Such examples may be particularly relevant when the host aircraft 10 is a UAV.

In some examples, the computing system 100 can also receive, at a second time $t_3$ that is subsequent to receiving the first authenticated signal 202, a third signal 214 that is an ADS-B signal that identifies a third position 216, a second velocity $v_3$, and a second aircraft type $T_2$. The third signal 214 includes a third identifier $U_3$ (e.g., any alphanumeric value).

Further, the computing system 100 can, based on finding a mismatch between the first identifier $U_1$ and the third identifier $U_3$ such that the third signal 214 corresponds to a second aircraft 218 that is distinct from the first aircraft 206, use the third position 216, the second velocity $v_3$, or the second aircraft type $T_2$ to confirm that it is possible that the second aircraft 218 is located at the third position 216 moving at the second velocity $v_3$ at the second time $t_3$. The computing system 100 can also, based on a confirmation that it is possible that the second aircraft 218 is located at the third position 216 moving at the second velocity $v_3$ at the second time $t_3$, provide (e.g., via the user interface 110) a second indication (e.g., displayed text, an audio alert, etc.) that the third signal 214 is authentic.

In some examples, the second indication provided by the computing system 100 can be less explicit in form, such as the computing system 100 controlling or maneuvering the host aircraft 10 based on the information included in the third signal 214 (e.g., based on an assumption that the second aircraft 218 is located at the third position 216 moving at the second velocity $v_3$ at the second time $t_3$). Additionally or alternatively, the second indication provided by the computing system 100 can include the computing system 100 transmitting a signal (e.g., to a control station on the ground) indicating that the third signal 214 is authentic. Such examples may be particularly relevant when the host aircraft 10 is a UAV.

In some examples, the computing system 100 using the third position 216, the second velocity $v_3$, or the second aircraft type $T_2$ to confirm that it is possible that the second aircraft 218 is located at the third position 216 moving at the second velocity $v_3$ at the second time $t_3$ includes determining that the third position 216 represents an altitude $a_3$ that is less than a maximum altitude of the second aircraft type $T_2$. The computing system 100 can also, prior to determining that the third position 216 represents the altitude $a_3$ that is less than the maximum altitude, determine the maximum altitude based on the second aircraft type $T_2$ (e.g., via a lookup table).

In some examples, the computing system 100 using the third position 216, the second velocity $v_3$, or the second aircraft type $T_2$ to confirm that it is possible that the second aircraft 218 is located at the third position 216 moving at the second velocity $v_3$ at the second time $t_3$ includes determining that the second velocity $v_3$ is less than a maximum velocity of the second aircraft type. The computing system 100, prior to determining that the second velocity $v_3$ is less than the maximum velocity, can determine the maximum velocity based on the second aircraft type $T_2$ (e.g., via a lookup table).

In some examples, the computing system 100 using the third position 216, the second velocity $v_3$, or the second aircraft type $T_2$ to confirm that it is possible that the second aircraft 218 is located at the third position 216 moving at the second velocity $v_3$ at the second time $t_3$ includes determining that the second velocity $v_3$ is greater than a minimum velocity of the second aircraft type $T_2$. The computing system 100, prior to determining that the second velocity $v_3$ is greater than the minimum velocity, can determine the minimum velocity based on the second aircraft type $T_2$ (e.g., via a lookup table).

In some examples, using the third position 216, the second velocity $v_3$, or the second aircraft type $T_2$ to confirm that it is possible that the second aircraft 218 is located at the third position 216 moving at the second velocity $v_3$ at the second time $t_3$ includes determining that a distance 220 (e.g., $d_3$) between the host aircraft 10 and the third position 216 is greater than a standard initial contact distance of ADS-B signals. That is, the computing system 100 determines whether it is reasonable that the first contact received via the ADS-B system from the second aircraft 218 occurred at the distance 220.

FIGS. 3-11 show flowcharts of the method 300, the method 313, the method 315, the method 317, the method 319, the method 321, the method 327, the method 329, and the method 331 for evaluating an ADS-B signal for authenticity, according to example implementations. The method 300, the method 313, the method 315, the method 317, the method 319, the method 321, the method 327, the method 329, and the method 331 present examples of methods that could be used with the computing system 100 shown in FIGS. 1-2. As shown in FIGS. 3-11, the method 300, the method 313, the method 315, the method 317, the method 319, the method 321, the method 327, the method 329, and the method 331 include one or more operations, functions, or actions as illustrated by blocks 302, 304, 306, 308, 310, 312, 314, 316, 318, 320, 322, 324, 326, 328, and 330. Although the blocks are illustrated in a sequential order, these blocks may also be performed in parallel, and/or in a different order than those described herein. Also, the various blocks may be combined into fewer blocks, divided into additional blocks, and/or removed based upon the desired implementation.

Referring to FIG. 3, block 302 of the method 300 includes receiving, by the computing system 100, the first authenticated signal 202 that (i) identifies the first position 204 of the first aircraft 206 relative to the host aircraft 10 on which the computing system 100 is located and (ii) includes the first identifier $U_1$ of the first aircraft 206.

Block 304 of the method 300 includes receiving, at the subsequent time $t_2$, the second signal 208 that is an ADS-B signal that identifies the second position 210, the velocity $v_2$, and the aircraft type $T_1$. The second signal 208 includes the second identifier $U_2$.

Block 306 of the method 300 includes, based on matching the first identifier $U_1$ and the second identifier $U_2$ such that the second signal 208 corresponds to the first aircraft 206, using the first position 204 and the aircraft type $T_1$ to confirm that it is possible that the first aircraft 206 is located at the second position 210 moving at the velocity $v_2$ at the subsequent time $t_2$.

Block 308 of the method 300 includes, based on a confirmation that it is possible that the first aircraft 206 is located at the second position 210 moving at the velocity $v_2$ at the subsequent time $t_2$, providing (e.g., via the user interface 110) an indication that the second signal 208 is authentic.

Referring to FIG. 4, block 310 of the method 313 includes, prior to determining that the second position 210 and the velocity $v_2$ conform to the flight plan, performing voice-to-text conversion of the first authenticated signal 202 to determine the flight plan.

Block 312 of the method 313 includes determining that the second position 210 and the velocity $v_2$ conform to the flight plan.

Referring to FIG. 5, block 314 of the method 315 includes, prior to determining that the distance 212 is less than the maximum distance, determining the maximum velocity based on the aircraft type $T_1$.

Referring to FIG. 6, block 316 of the method 317 includes, prior to determining that the distance 212 is more than the minimum distance, determining the minimum velocity based on the aircraft type $T_1$.

Referring to FIG. 7, block 318 of the method 319 includes, prior to determining that the second position 210 represents the altitude $a_2$ that is less than the maximum altitude, determining the maximum altitude based on the aircraft type $T_1$.

Referring to FIG. 8, block 320 of the method 321 includes receiving, at the second time $t_3$ that is subsequent to receiving the first authenticated signal 202, the third signal 214 that is an ADS-B signal that identifies the third position 216, the second velocity $v_3$, and the second aircraft type $T_2$. The third signal 214 includes a third identifier $U_3$.

Block 322 of the method 321 includes, based on finding a mismatch between the first identifier $U_1$ and the third identifier $U_3$ such that the third signal 214 corresponds to the second aircraft 218, using the third position 216, the second velocity $v_3$, or the second aircraft type $T_2$ to confirm that it is possible that the second aircraft 218 is located at the third position 216 moving at the second velocity $v_3$ at the second time $t_3$.

Block 324 of the method 321 includes, based on a confirmation that it is possible that the second aircraft 218 is located at the third position 216 moving at the second velocity $v_3$ at the second time $t_3$, providing (e.g., via the user interface 110) a second indication that the third signal 214 is authentic.

Referring to FIG. 9, block 326 of the method 327 includes, prior to determining that the third position 216 represents the altitude $a_3$ that is less than the maximum altitude, determining the maximum altitude based on the second aircraft type $T_2$.

Referring to FIG. 10, block 328 of the method 329 includes, prior to determining that the second velocity $v_3$ is less than the maximum velocity, determining the maximum velocity based on the second aircraft type $T_2$.

Referring to FIG. 11, block 330 of the method 331 includes, prior to determining that the second velocity $v_3$ is greater than the minimum velocity, determining the minimum velocity based on the second aircraft type $T_2$.

It should be understood that for this and other processes and methods disclosed herein, flowcharts show functionality and operation of one possible implementation of present examples. Alternative implementations are included within the scope of the examples of the present disclosure in which functions may be executed out of order from that shown or discussed, including substantially concurrent or in reverse order, depending on the functionality involved, as would be understood by those reasonably skilled in the art.

Examples of the present disclosure can thus relate to one of the enumerated clauses (EC) listed below.

EC 1 is a computing system for evaluating an Automatic Dependent Surveillance-Broadcast (ADS-B) signal for authenticity, the computing system comprising: one or more processors; and a computer readable medium storing instructions that, when executed by the one or more processors, cause the computing system to perform functions comprising: receiving a first authenticated signal that (i) identifies a first position of a first aircraft relative to a host aircraft on which the computing system is located and (ii) includes a first identifier of the first aircraft; receiving, at a subsequent time, a second signal that is an ADS-B signal that identifies a second position, a velocity, and an aircraft type, wherein the second signal includes a second identifier; based on matching the first identifier and the second identifier such that the second signal corresponds to the first aircraft, using the first position and the aircraft type to confirm that it is possible that the first aircraft is located at the second position moving at the velocity at the subsequent time; and based on a confirmation that it is possible that the first aircraft is located at the second position moving at the velocity at the subsequent time, providing an indication that the second signal is authentic.

EC 2 is the computing system of EC 1, wherein the first authenticated signal is a Traffic Collision Avoidance System (TCAS) signal, an air traffic control voice (ATCV) signal that encodes air traffic control audio, or a Controller Pilot Data Link (CPDL) signal.

EC 3 is the computing system of EC 1, wherein the first authenticated signal is an air traffic control voice (ATCV) signal or a Controller Pilot Data Link (CPDL) signal that indicates a flight plan of the first aircraft, the functions further comprising: determining that the second position and the velocity conform to the flight plan.

EC 4 is the computing system of EC 3, wherein the first authenticated signal is an ATCV signal, the functions further comprising: prior to determining that the second position and the velocity conform to the flight plan, performing voice-to-text conversion of the first authenticated signal to determine the flight plan.

EC 5 is the computing system of any of ECs 1-4, wherein the first authenticated signal is received at a first time, and wherein using the first position and the aircraft type to confirm that it is possible that the first aircraft is located at the second position moving at the velocity at the subsequent time comprises: determining that a distance between the first position and the second position is less than a maximum distance that the first aircraft could have travelled at a maximum velocity of the aircraft type between the first time and the subsequent time.

EC 6 is the computing system of EC 5, the functions further comprising: prior to determining that the distance is less than the maximum distance, determining the maximum velocity based on the aircraft type.

EC 7 is the computing system of any of ECs 1-6, wherein the first authenticated signal is received at a first time, and wherein using the first position and the aircraft type to confirm that it is possible that the first aircraft is located at the second position moving at the velocity at the subsequent time comprises: determining that a distance between the first position and the second position is more than a minimum distance that the first aircraft could have travelled at a minimum velocity of the aircraft type between the first time and the subsequent time.

EC 8 is the computing system of EC 7, the functions further comprising: prior to determining that the distance is more than the minimum distance, determining the minimum velocity based on the aircraft type.

EC 9 is the computing system of any of ECs 1-8, wherein using the first position and the aircraft type to confirm that it is possible that the first aircraft is located at the second position moving at the velocity at the subsequent time further comprises: determining that the second position represents an altitude that is less than a maximum altitude of the aircraft type EC 10 is the computing system of EC 9, the functions further comprising: prior to determining that the second position represents the altitude that is less than the maximum altitude, determining the maximum altitude based on the aircraft type.

EC 11 is the computing system of any of ECs 1-10, the functions further comprising: receiving, at a second time that is subsequent to receiving the first authenticated signal, a third signal that is an ADS-B signal that identifies a third position, a second velocity, and a second aircraft type, wherein the third signal includes a third identifier; based on finding a mismatch between the first identifier and the third identifier such that the third signal corresponds to a second aircraft, using the third position, the second velocity, or the second aircraft type to confirm that it is possible that the second aircraft is located at the third position moving at the second velocity at the second time; and based on a confirmation that it is possible that the second aircraft is located at the third position moving at the second velocity at the second time, providing a second indication that the third signal is authentic.

EC 12 is the computing system of EC 11, wherein using the third position, the second velocity, or the second aircraft type to confirm that it is possible that the second aircraft is located at the third position moving at the second velocity at the second time comprises: determining that the third position represents an altitude that is less than a maximum altitude of the second aircraft type.

EC 13 is the computing system of EC 12, the functions further comprising: prior to determining that the third position represents the altitude that is less than the maximum altitude, determining the maximum altitude based on the second aircraft type.

EC 14 is the computing system of any of ECs 11-13, wherein using the third position, the second velocity, or the second aircraft type to confirm that it is possible that the second aircraft is located at the third position moving at the second velocity at the second time comprises: determining that the second velocity is less than a maximum velocity of the second aircraft type.

EC 15 is the computing system of EC 14, the functions further comprising: prior to determining that the second velocity is less than the maximum velocity, determining the maximum velocity based on the second aircraft type.

EC 16 is the computing system of any of ECs 11-15, wherein using the third position, the second velocity, or the second aircraft type to confirm that it is possible that the second aircraft is located at the third position moving at the second velocity at the second time comprises: determining that the second velocity is greater than a minimum velocity of the second aircraft type.

EC 17 is the computing system of EC 16, the functions further comprising: prior to determining that the second velocity is greater than the minimum velocity, determining the minimum velocity based on the second aircraft type.

EC 18 is the computing system of any of ECs 11-17, wherein using the third position, the second velocity, or the second aircraft type to confirm that it is possible that the second aircraft is located at the third position moving at the second velocity at the second time comprises: determining that a distance between the host aircraft and the third position is greater than a standard initial contact distance of ADS-B signals.

EC 19 is a non-transitory computer readable medium storing instructions that, when executed by a computing system, cause the computing system to perform functions for evaluating an Automatic Dependent Surveillance-Broadcast (ADS-B) signal for authenticity, the functions comprising: receiving a first authenticated signal that (i) identifies a first position of a first aircraft relative to a host aircraft on which the computing system is located and (ii) includes a first identifier of the first aircraft; receiving, at a subsequent time, a second signal that is an ADS-B signal that identifies a second position, a velocity, and an aircraft type, wherein the second signal includes a second identifier; based on matching the first identifier and the second identifier such that the second signal corresponds to the first aircraft, using the first position and the aircraft type to confirm that it is possible that the first aircraft is located at the second position moving at the velocity at the subsequent time; and based on a confirmation that it is possible that the first aircraft is located at the second position moving at the velocity at the subsequent time, providing an indication that the second signal is authentic.

EC 20 is a method for evaluating an Automatic Dependent Surveillance-Broadcast (ADS-B) signal for authenticity, the method comprising: receiving, by a computing system, a first authenticated signal that (i) identifies a first position of a first aircraft relative to a host aircraft on which the computing system is located and (ii) includes a first identifier of the first aircraft; receiving, at a subsequent time, a second signal that is an ADS-B signal that identifies a second position, a velocity, and an aircraft type, wherein the second signal includes a second identifier; based on matching the first identifier and the second identifier such that the second signal corresponds to the first aircraft, using the first position and the aircraft type to confirm that it is possible that the first aircraft is located at the second position moving at the velocity at the subsequent time; and based on a confirmation that it is possible that the first aircraft is located at the second position moving at the velocity at the subsequent time, providing an indication that the second signal is authentic.

The description of the different advantageous arrangements has been presented for purposes of illustration and description, and is not intended to be exhaustive or limited to the examples in the form disclosed. Many modifications and variations will be apparent to those of ordinary skill in the art. Further, different advantageous examples may describe different advantages as compared to other advantageous examples. The example or examples selected are chosen and described in order to explain the principles of the examples, the practical application, and to enable others of ordinary skill in the art to understand the disclosure for various examples with various modifications as are suited to the particular use contemplated.

What is claimed is:

1. A computing system for evaluating an Automatic Dependent Surveillance-Broadcast (ADS-B) signal for authenticity, the computing system comprising:

one or more processors; and a computer readable medium storing instructions that, when executed by the one or more processors, cause the computing system to perform functions comprising:

receiving a first authenticated signal that (i) identifies a first position of a first aircraft relative to a host aircraft on which the computing system is located and (ii) includes a first identifier of the first aircraft;

receiving, at a subsequent time, a second signal that is an ADS-B signal that identifies a second position, a velocity, and an aircraft type, wherein the second signal includes a second identifier;

based on matching the first identifier and the second identifier such that the second signal corresponds to the first aircraft, using the first position and the aircraft type to confirm that it is possible that the first aircraft is located at the second position moving at the velocity at the subsequent time;

determining that a distance between the host aircraft and the second position is greater than a standard initial contact distance of ADS-B signals; and based on a confirmation that it is possible that the first aircraft is located at the second position moving at the velocity at the subsequent time and that the distance is greater than the standard initial contact distance of ADS-B signals, providing an indication that the second signal is authentic.

2. The computing system of claim 1, wherein the first authenticated signal is a Traffic Collision Avoidance System (TCAS) signal, an air traffic control voice (ATCV) signal that encodes air traffic control audio, or a Controller Pilot Data Link (CPDL) signal.

3. The computing system of claim 1, wherein the first authenticated signal is an air traffic control voice (ATCV) signal or a Controller Pilot Data Link (CPDL) signal that indicates a flight plan of the first aircraft, the functions further comprising:

determining that the second position and the velocity conform to the flight plan.

4. The computing system of claim 3, wherein the first authenticated signal is an ATCV signal, the functions further comprising:

prior to determining that the second position and the velocity conform to the flight plan, performing voice-to-text conversion of the first authenticated signal to determine the flight plan.

5. The computing system of claim 1, wherein the first authenticated signal is received at a first time, and wherein using the first position and the aircraft type to confirm that it is possible that the first aircraft is located at the second position moving at the velocity at the subsequent time comprises:

determining that a distance between the first position and the second position is less than a maximum distance that the first aircraft could have travelled at a maximum velocity of the aircraft type between the first time and the subsequent time.

6. The computing system of claim 5, the functions further comprising:

prior to determining that the distance is less than the maximum distance, determining the maximum velocity based on the aircraft type.

7. The computing system of claim 1, wherein the first authenticated signal is received at a first time, and wherein using the first position and the aircraft type to confirm that it is possible that the first aircraft is located at the second position moving at the velocity at the subsequent time comprises:

determining that a distance between the first position and the second position is more than a minimum distance that the first aircraft could have travelled at a minimum velocity of the aircraft type between the first time and the subsequent time.

8. The computing system of claim 7, the functions further comprising:

prior to determining that the distance is more than the minimum distance, determining the minimum velocity based on the aircraft type.

9. The computing system of claim 1, wherein using the first position and the aircraft type to confirm that it is possible that the first aircraft is located at the second position moving at the velocity at the subsequent time further comprises:

determining that the second position represents an altitude that is less than a maximum altitude of the aircraft type.

10. The computing system of claim 9, the functions further comprising:

prior to determining that the second position represents the altitude that is less than the maximum altitude, determining the maximum altitude based on the aircraft type.

11. The computing system of claim 1, the functions further comprising:

receiving, at a second time that is subsequent to receiving the first authenticated signal, a third signal that is an ADS-B signal that identifies a third position, a second velocity, and a second aircraft type, wherein the third signal includes a third identifier;

based on finding a mismatch between the first identifier and the third identifier such that the third signal corresponds to a second aircraft, using the third position, the second velocity, or the second aircraft type to confirm that it is possible that the second aircraft is located at the third position moving at the second velocity at the second time; and based on a confirmation that it is possible that the second aircraft is located at the third position moving at the second velocity at the second time, providing a second indication that the third signal is authentic.

12. The computing system of claim 11, wherein using the third position, the second velocity, or the second aircraft type to confirm that it is possible that the second aircraft is located at the third position moving at the second velocity at the second time comprises:

determining that the third position represents an altitude that is less than a maximum altitude of the second aircraft type.

13. The computing system of claim 12, the functions further comprising:

prior to determining that the third position represents the altitude that is less than the maximum altitude, determining the maximum altitude based on the second aircraft type.

14. The computing system of claim 11, wherein using the third position, the second velocity, or the second aircraft type to confirm that it is possible that the second aircraft is located at the third position moving at the second velocity at the second time comprises:

determining that the second velocity is less than a maximum velocity of the second aircraft type.

15. The computing system of claim 14, the functions further comprising:

prior to determining that the second velocity is less than the maximum velocity, determining the maximum velocity based on the second aircraft type.

16. The computing system of claim 11, wherein using the third position, the second velocity, or the second aircraft type to confirm that it is possible that the second aircraft is located at the third position moving at the second velocity at the second time comprises:

determining that the second velocity is greater than a minimum velocity of the second aircraft type.

17. The computing system of claim 16, the functions further comprising:

prior to determining that the second velocity is greater than the minimum velocity, determining the minimum velocity based on the second aircraft type.

18. The computing system of claim 11, wherein using the third position, the second velocity, or the second aircraft type to confirm that it is possible that the second aircraft is located at the third position moving at the second velocity at the second time comprises:

determining that a distance between the host aircraft and the third position is greater than a standard initial contact distance of ADS-B signals.

19. A non-transitory computer readable medium storing instructions that, when executed by a computing system, cause the computing system to perform functions for evaluating an Automatic Dependent Surveillance-Broadcast (ADS-B) signal for authenticity, the functions comprising:

receiving a first authenticated signal that (i) identifies a first position of a first aircraft relative to a host aircraft on which the computing system is located and (ii) includes a first identifier of the first aircraft;

receiving, at a subsequent time, a second signal that is an ADS-B signal that identifies a second position, a velocity, and an aircraft type, wherein the second signal includes a second identifier;

based on matching the first identifier and the second identifier such that the second signal corresponds to the first aircraft, using the first position and the aircraft type to confirm that it is possible that the first aircraft is located at the second position moving at the velocity at the subsequent time;

determining that a distance between the host aircraft and the second position is greater than a standard initial contact distance of ADS-B signals; and based on a confirmation that it is possible that the first aircraft is located at the second position moving at the velocity at the subsequent time and that the distance is greater than the standard initial contact distance of ADS-B signals, providing an indication that the second signal is authentic.

20. A method for evaluating an Automatic Dependent Surveillance-Broadcast (ADS-B) signal for authenticity, the method comprising:

receiving, by a computing system a first authenticated signal that (i) identifies a first position of a first aircraft relative to a host aircraft on which the computing system is located and (ii) includes a first identifier of the first aircraft;

receiving, at a subsequent time, a second signal that is an ADS-B signal that identifies a second position, a velocity, and an aircraft type, wherein the second signal includes a second identifier;

based on matching the first identifier and the second identifier such that the second signal corresponds to the first aircraft, using the first position and the aircraft type to confirm that it is possible that the first aircraft is located at the second position moving at the velocity at the subsequent time;

determining that a distance between the host aircraft and the second position is greater than a standard initial contact distance of ADS-B signals; and based on a confirmation that it is possible that the first aircraft is located at the second position moving at the velocity at the subsequent time and that the distance is greater than the standard initial contact distance of ADS-B signals, providing an indication that the second signal is authentic.

* * * * *